US006105686A

United States Patent [19]

Niemi

[11] Patent Number: 6,105,686

[45] Date of Patent: Aug. 22, 2000

[54] PRESSURE ACCUMULATOR ARRANGEMENT IN CONNECTION WITH A HYDRAULICALLY OPERATED IMPACT DEVICE, SUCH AS A BREAKING APPARATUS

[75] Inventor: Ilkka Niemi, Lahti, Finland

[73] Assignee: Tamrock OY, Finland

[21] Appl. No.: 09/266,024

[22] Filed: Mar. 11, 1999

[30] Foreign Application Priority Data

Mar. 30, 1998 [FI] Finland ..... 980716

[51] Int. Cl.[7] ..... B25D 9/00

[52] U.S. Cl. ..... 173/208; 91/276; 173/204; 173/212

[58] Field of Search ..... 173/208, 207, 173/DIG. 4, 204, 212, 138, 132, 200; 92/134; 91/276, 321, 328, 303

[56] References Cited

U.S. PATENT DOCUMENTS

| | | | |
|---|---|---|---|
| 3,490,549 | 1/1970 | Catterson | 173/207 |
| 3,739,863 | 6/1973 | Wohlwend | 173/DIG. 4 |
| 3,896,889 | 7/1975 | Bouyoucos | 91/276 |
| 3,903,972 | 9/1975 | Bouyoucos et al. | 173/208 |
| 3,911,789 | 10/1975 | Bouyoucos | 91/321 |
| 4,264,107 | 4/1981 | Janach et al. | 173/DIG. 4 |
| 4,474,248 | 10/1984 | Musso | 173/208 |
| 4,508,017 | 4/1985 | Montabert | 173/200 |
| 4,552,227 | 11/1985 | Wohlwend | 173/204 |
| 5,174,386 | 12/1992 | Crover | 173/132 |
| 5,392,865 | 2/1995 | Piras | 173/138 |
| 5,893,419 | 4/1999 | Hodges | 173/204 |
| 5,944,120 | 8/1999 | Barden | 173/212 |

FOREIGN PATENT DOCUMENTS

| | | | |
|---|---|---|---|
| 2054753 | 2/1981 | United Kingdom | 173/208 |
| WO 94/03292 | 2/1994 | WIPO . | |

*Primary Examiner*—Peter Vo
*Assistant Examiner*—Jim Calve
*Attorney, Agent, or Firm*—Nixon & Vanderhye P.C.

[57] ABSTRACT

The invention relates to an arrangement in connection with a hydraulically operated impact device, such as a breaking apparatus. The impact device includes a percussion piston, conduits for feeding pressure fluid into and out of the impact device, and a pressure accumulator. According to the inventive idea, the pressure accumulator is formed as an annular structure surrounding the percussion piston. It consists of sleeve-shaped pressure chambers that are separated by a sleeve-like diaphragm arranged between a frame and a sleeve. The pressure chambers are formed such that the inner circumference of the sleeve placed around the frame and the outer circumference of the frame are provided with recesses opposite one another.

4 Claims, 1 Drawing Sheet

PRESSURE ACCUMULATOR ARRANGEMENT IN CONNECTION WITH A HYDRAULICALLY OPERATED IMPACT DEVICE, SUCH AS A BREAKING APPARATUS

BACKGROUND OF THE INVENTION

The invention relates to an arrangement in connection with a hydraulically operated impact device, such as a breaking apparatus, the impact device comprising at least a frame and a percussion piston, which is arranged to perform a reciprocating motion due to the pressure of the pressure fluid, and further means for feeding the pressure fluid into and out of the impact device, and a pressure accumulator which is connected to a pressure fluid space in the percussion piston, the accumulator being formed substantially along its entire length as an annular space surrounding the percussion piston by placing around the frame a separate sleeve comprising an annular recess, the annular space around the percussion piston being divided into two separate pressure chambers by a sleeve-like diaphragm, one of the pressure chambers being filled by a pressurized compressible medium, and the other pressure chamber being connected to a pressure fluid space of the percussion piston.

Hydraulic impact devices, such as breaking apparatuses, percussion hammers, rock drilling apparatuses and the like, are generally used to break relatively hard materials, for example stone, concrete, asphalt, frozen soil, metal slag etc. Percussion hammers are usually installed as auxiliary equipment in excavators instead of buckets, but other base machines and carriers can also be used. Thus the carrier may also be stationary. Percussion hammers are usually operated by the hydraulics of the base machine.

Hydraulic breaking apparatuses as well as other hydraulically operated machines and apparatuses employ different pressure accumulators for example to even pressure variations resulting from the cycle of operation of the machines. The pressure accumulators comprise a pressure-tight space, which is divided into at least two separate smaller spaces by means of a pressure-tight diaphragm. To the first side of the diaphragm is applied a predetermined gas pressure. The pressurized gas may be, for example, nitrogen or some other gas that is suitable for the purpose. To the second side of the diaphragm it is possible to supply pressure fluid that pushes the diaphragm forward, thus making the pressure medium provided on the first side of the diaphragm compress. However, the structure simultaneously stores energy that can be released, if required, in order to supply the pressure fluid to the desired destination. In this manner, a certain volume of pressurized fluid can be stored in the pressure accumulator. The diaphragm in the pressure accumulators is typically planar, cuplike or bladder like, and the diaphragm is placed in a spherical, cylindrical or flat frame that is separate from the rest of the actuator. In connection with impact devices, pressure accumulators are used to even out pressure variations resulting from impacts delivered by the impact piston. However, the problem with the present pressure accumulators used in impact devices is that the diaphragm thereof changes its form uncontrollably, since a momentary volume flow of the pressure fluid into or from the pressure accumulator is great and the amount of the volume flow in the pressure accumulators varies suddenly. Also, in the present pressure accumulators the material of the diaphragm is subjected to great strains and deformations, which means that the material is constantly under stress and therefore it has an unnecessarily short service life. When a diaphragm breaks, it always stops the production and creates extra costs.

In another prior art arrangement, a protruding pressure accumulator is provided at the upper end of a hydraulic percussion hammer on an extension thereof. The pressure accumulator consists of a casing that is separate from the rest of the structure, a sleeve-like diaphragm, and a metal screen placed against the inside of the diaphragm. Between the casing and the diaphragm there is a pressure space for gas, and inside the screen there is a space for pressure fluid. A disadvantage of such a structure is that when the piston has moved to its lower position, the diaphragm is pressed rapidly against the screen and may thus be damaged as it touches the openings in the screen. In time, depressions or the like may be formed in the diaphragm, whereupon the diaphragm breaks easily at these points. As in the other prior art arrangements, another problem of the aforementioned solution is that the pressure accumulator is an element which protrudes from the rest of the structure and which is thus exposed to blows and the influence of the surrounding conditions. Such a protrusion also makes the apparatus more difficult to handle. Further, a pressure accumulator provided on an extension of the percussion hammer adds to the total length of the apparatus, which is naturally disadvantageous to the use of the apparatus.

SUMMARY OF THE INVENTION

The purpose of the present invention is to provide such a pressure accumulator arrangement in a hydraulically operated impact device that avoids the prior art drawbacks.

The arrangement according to the invention is characterized by the outer circumference of the frame being provided with a first annular recess for forming the first pressure chamber, and the sleeve being correspondingly provided with a second annular recess for forming the second pressure chamber, and the sleeve-like diaphragm being positioned between the frame and the sleeve.

A basic idea of the invention is that the percussion piston is surrounded by an annular space that is divided by a sleeve-like diaphragm into two separate pressure chambers, one of which is arranged to receive pressure fluid, and the other one is prefilled with a compressible medium, such as gas. The result is a pressure accumulator which can be used to accumulate pressurized pressure fluid. Another basic idea is that the pressure accumulator is positioned substantially along its entire length around the percussion piston. Further, the basic idea of the invention is that the outer circumference of the frame of the impact device is provided with a recess for a first pressure chamber, and that the frame of the impact device is surrounded by a sleeve the inner circumference of which is correspondingly provided with a recess for forming a second pressure chamber. The diaphragm separating the pressure chambers is pressed from its edges between the sleeve and the frame. The ends of the diaphragm are preferably provided with protrusions, and the frame and/or the sleeve are provided with grooves for fastening the diaphragm.

An advantage of the invention is that due to the structure of the arrangement, the movements of the diaphragm of the pressure accumulator can be controlled. Therefore, the deformations taking place in the diaphragm, such as strains, are less significant than previously, wherefore the diaphragm has a longer service life and its structure requires less repairs. Further, since the diaphragm now has a large moving area, it may have a lower speed of motion and a shorter distance of motion than previously. This also prevents the wearing of the diaphragm. Advantageously to the service life of the diaphragm, the diaphragm is not connected to the surface of the first pressure chamber during the cycle of operation of the impact device. Due to a low speed of motion, the operation of the diaphragm can be controlled even if the volume flow of the pressure fluid into or out of the accumulator were great. Another advantage is that power losses are smaller than previously, since in the present arrangement it is not necessary to move pressurized fluid over long distances along different ducts, but the pressure accumulator can be placed in the immediate vicinity of the percussion piston. Another advantage is that since the pressure accumulator arrangement is formed around the actual impact device, it is protected from blows and the harmful effects of dirt and weather as it is situated inside the protective casing together with the rest of the structure. Thus, the accumulator is not in any way separate from the impact device nor does it protrude from it. Therefore, the structure is more compact than previously and it also looks better. Further, since the pressure accumulator is integrated around the percussion piston in connection with the actual apparatus, the length of the impact device does not have to be increased disadvantageously due to the pressure accumulator. For example, diminishing the outer dimensions of the breaking apparatus is advantageous to the use and operability of the apparatus. A further advantage is that the accumulator has less components than previously, wherefore it is also cheaper to manufacture. The first part of the pressure chamber can be machined in a simple manner straight to the frame of the impact device, and correspondingly, the second part can be machined directly to a sleeve provided between the frame and the protective casing. Since the pressure accumulator is situated in the immediate vicinity of the impact device, there is less need to provide the structure with long bores that would be difficult to prepare or with other ducts for transferring hydraulic fluid between the accumulator and the percussion piston. The structure of the accumulator can be manufactured in a surprisingly simple manner. Further, the impact device may have a modular structure, which means that the properties of the device can be varied just by installing a sleeve and/or a frame that has a different volume of the recess.

BRIEF DESCRIPTION OF THE DRAWINGS

The invention will be described in greater detail in the accompanying drawing, in which.

DETAILED DESCRIPTION OF THE INVENTION

Figure 1:
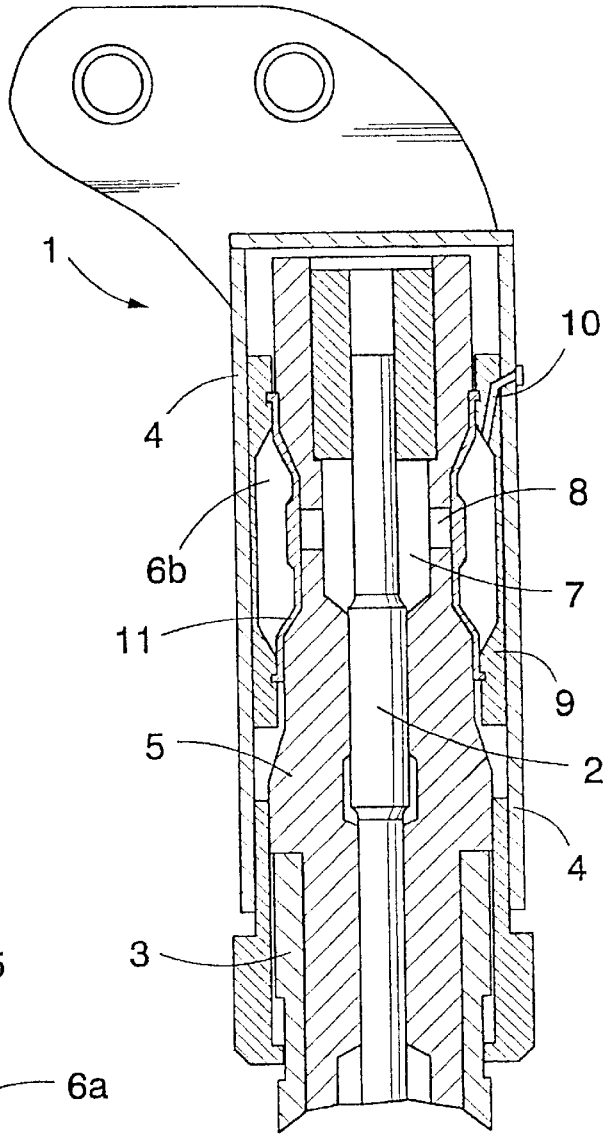
FIG. 1 is a schematic sectional side view of a breaking apparatus applying an arrangement according to the invention for forming a pressure accumulator.
Figure 3:
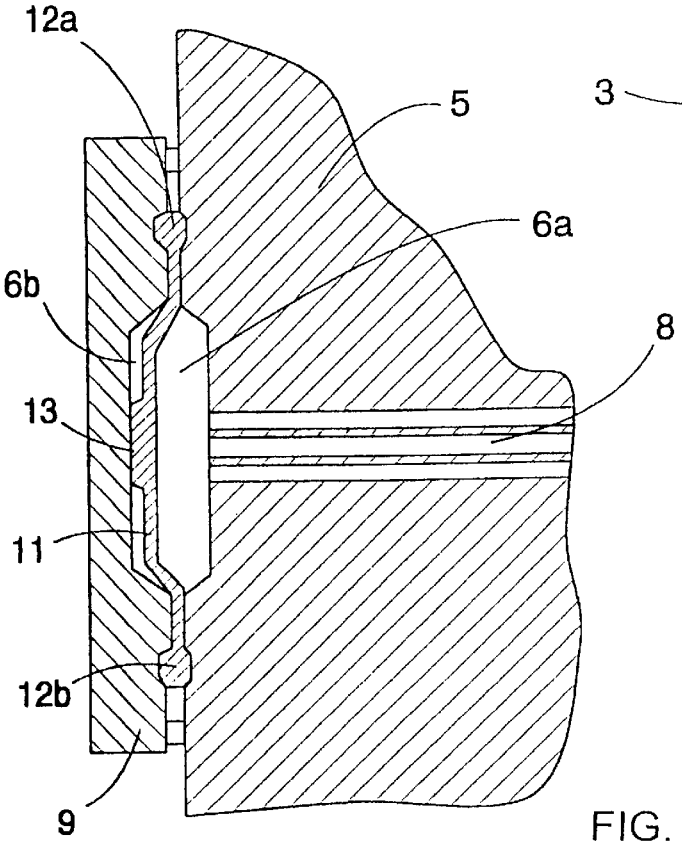
FIG. 3 is a schematic sectional view of a detail of the arrangement.

FIG. 1 is a sectional view of an upper end of a hydraulically operated impact device, in this case a breaking apparatus. Such a breaking apparatus 1, which is also referred to generally as a percussion or hydraulic hammer, can be connected to a boom or the like in an excavator or some other machine in a manner known per se. Since the structure and operation of percussion hammers is generally known in the field, the breaking apparatus is shown in a very simplified form at least regarding the components that are not essentially related to the present invention. The percussion hammer comprises a percussion piston 2 which performs a reciprocating motion due to the action of pressure fluid 20, 30 and which delivers consecutive blows at the object to be broken via a tool 3 that is shown only partly. The percussion hammer is surrounded by a protective casing 4, which may consist, for example, of bent steel plates that are connected together with suitable connecting means and provided with seals and appropriate vibration damping elements. The protective casing may also be a tubular structure that is closed from one end. It should be noted that the figure does not show, for the sake of clarity, all the ducts for pressure fluid that are necessary for the operation of the apparatus, but only the ducts that are essential for the invention. Further, the percussion hammer comprises a frame 5 that has preferably a circular cross-section. The outer circumference of the frame is provided with a first recess 50, for example through cutting, the recess 50 forming a first pressure chamber 6*a* of the pressure accumulator that can be seen below in FIG. 3. One or more ducts 8 are connected to the pressure chamber 6*a* from a pressure fluid space 7 of the percussion piston 2, pressure fluid flowing into and out of the pressure chamber 6*a* via the ducts. The arrangement further comprises a sleeve 9 which is placed around the frame and which is supported at least vertically in the space between the protective casing 4 and the frame 5. The inner circumference of the sleeve is provided, for example through cutting, with a second recess 40 that preferably corresponds substantially to the shape of the recess in the frame, the second recess 40 being arranged at a corresponding point with the recess of the frame. The recess of the sleeve forms a second pressure chamber 6*b* for the compressible medium of the pressure accumulator, such as nitrogen gas. A predetermined amount of this medium is fed into the pressure chamber at a particular filling pressure along a separate channel 10. Between the sleeve 9 and the frame 5 there is a diaphragm 11 which divides the pressure chambers 6*a* and 6*b* in the radial direction and which is a sleeve-like component that is open at its ends. The diaphragm is able to move radially due to the action of the pressurized gas and the pressure fluid. The position of the diaphragm in the radial direction at each moment depends on the ratio of the pressures prevailing in the pressure chambers 6*a* and 6*b*, i.e. on different sides of the diaphragm. When there is no pressure in the pressure chamber 6*a* between the diaphragm and the frame, the gas presses the diaphragm against the bottom of the recess formed in the frame, as shown in FIG. 1. When pressurized fluid is supplied to the pressure fluid space 7 of the percussion piston or when the piston pushes the fluid in this space during its return motion, pressurized fluid flows from the pressure fluid duct 8 to the pressure chamber 6*a*. Consequently, the diaphragm moves over a distance that is proportional to the pressure in the radial direction towards the bottom of the recess in the sleeve 9, i.e. it moves over to the side of the pressure chamber 6*b* as shown in FIG. 3. The pressurized medium on the opposite side of the diaphragm naturally resists the movement of the diaphragm, but due to a higher pressure it is forced to compress. The accumulator is thus charged with a static pressure, which can be released and utilized during the next blow of the percussion piston. Therefore, it is possible to make the normal conduits for supplying the medium and leading to the percussion piston smaller than previously. Further, power losses are smaller since it is not necessary to transfer a great volume of pressurized medium over long distances inside the percussion hammer. The diaphragm of the pressure accumulator thus performs a reciprocating movement during one cycle of operation or up-and-down motion of the percussion piston. When the piston is in the upper position, the pressure accumulator is charged, and correspondingly, when the piston has delivered a blow and is in the lower position, the pressure accumulator is in the state shown in FIG. 1 but it does not come into contact with the surface of the pressure chamber 6*a*. When the apparatus is out of operation and there is no pressure of the pressure medium in the pressure fluid space 7, the diaphragm is pressed against the surface of the pressure chamber 6*a* due to the prefilling pressure of the gas. The pressure accumulator can easily be made rather long in the vertical direction of the percussion hammer without any effect on the outer dimensions of the breaking apparatus. The pressure accumulator can thus be made rather flat in the radial direction, yet the volume of the accumulator may be great. Due to the flat structure the diaphragm moves only over a short distance, which means that also the deformations of the diaphragm are smaller than previously. Therefore the diaphragm naturally wears to a smaller extent and it does not break so easily.

Figure 2:
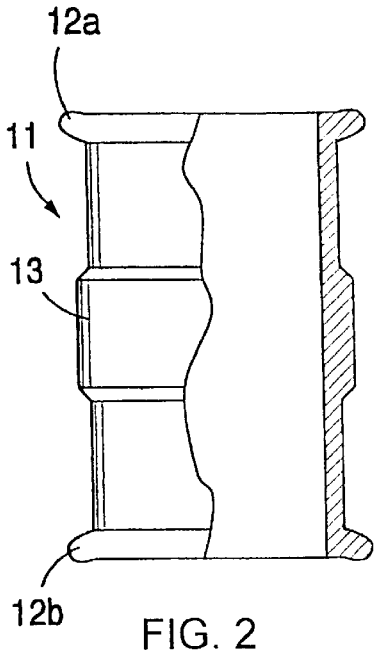
FIG. 2 is a schematic side view, in partial section, of a sleeve-like diaphragm in a pressure accumulator arrangement according to the invention in a position that corresponds to an unpressurized state.

FIG. 2 is a side view of the diaphragm 11 of the pressure accumulator according to the invention, with the right side of the diaphragm shown in a sectional view for the sake of clarity. The diaphragm is a cylindrical element with a substantially circular cross-section which is open at both ends and which is made of an elastic material. The material of the diaphragm must be resistant to hydraulic oil and the gas used in the accumulator, and it must also withstand without breaking the mechanical stresses subjected thereon. The diaphragm may be made of, for example, a suitable rubber or plastic material that has the aforementioned characteristics, or a combination thereof. The sleeve-like diaphragm 11 comprises at its ends projections 12*a* and 12*b* for fastening it, and a vertical enlargement 13 in the middle of the diaphragm. The enlargement 13 is arranged to be placed at the ducts 8 leading to the pressure chamber 6*a*, so that the diaphragm is stronger at this point as it receives the pressure fluid that is supplied from the duct at a great pressure. On the other hand, the enlargement 13 prevents the diaphragm from pressing into the duct 8, wherefore no separate screen or the like is necessarily needed at the opening of the duct. The projections 12*a* and 12*b* at the ends of the diaphragm are formed to correspond substantially to grooves formed in the frame and/or the sleeve for the purpose of fastening. When the frame 5 and the sleeve 9 are pressed tightly together, they press the edges of the diaphragm from both ends tightly in place between them, and the projections 12*a* and 12*b* of the diaphragm are placed in the respective grooves 60, 70 or the like provided for them. Even though the figure shows the projections of the diaphragm only on the outer circumference thereof, the projections can also be formed only on the inner circumference or on both the inner and the outer circumference of the diaphragm.

FIG. 3 shows a detail of the arrangement according to the invention in order to further clarify the structure thereof. The pressure accumulator is shown here in the charged state, which means that pressure fluid has been fed into the pressure chamber 6*a* and it has pushed the diaphragm 11 over to the side of the pressure chamber 6*b*. The position of the diaphragm is shown in an exaggerated manner in the figure for the sake of clarity. Both the sleeve 9 and the frame 5 are provided with grooves for fastening the diaphragm, the grooves being spaced from the edges of the recesses formed in the sleeve and the frame. The enlargements 12*a* and 12*b* provided at the ends of the sleeve-like diaphragm are arranged to be placed in these grooves when the sleeve and the frame are pressed tightly together. In some cases, a groove can be formed only in the sleeve or in the frame, as long as the diaphragm can be secured from its edges between the sleeve and the frame. The diaphragm also operates as a seal between the frame and the sleeve so that the impervious pressure chambers 6*a* and 6*b* can be formed without any separate seals between these sections. The sleeve may be attached to the frame with a bolt or some other corresponding connection.

The drawing and the description related thereto are only intended to illustrate the inventive idea. The details of the invention may vary within the scope of the claims. Therefore, in principle the pressure chambers can be formed in an opposite manner compared to the figures and the description, such that the first pressure chamber 6*a* between the frame and the diaphragm may be filled with pressurized gas, whereas hydraulic pressure is applied to the second pressure chamber 6*b* between the sleeve and the diaphragm. It is also possible to provide several separate annular pressure accumulators one after another in the axial direction of the percussion piston. For example when two such pressure accumulators are applied, the first one may be connected to the low-pressure system and the second one to the high-pressure system of the percussion piston. It is also possible to connect one accumulator to a return duct for pressure fluid. In principle, such a pressure accumulator may be connected to any pressure fluid space of the percussion piston depending on the construction of the apparatus.

What is claimed is:

1. A pressure accumulator arrangement in connection with a hydraulically operated impact device, such as a breaking apparatus, the impact device comprising at least an outer casing, a frame and a percussion piston, which is arranged to perform a reciprocating motion due to the pressure of the pressure fluid, and further means for feeding the pressure fluid into and out of the impact device, and a pressure accumulator which is connected to a pressure fluid space in the percussion piston, the accumulator being formed substantially along its entire length as an annular space surrounding the percussion piston by placing within the outer casing and around the frame a separate sleeve comprising an annular recess, the annular space around the percussion piston being formed between the frame and the sleeve and being divided into two separate pressure chambers by a sleeve-like diaphragm, one of the pressure chambers being filled by a pressurized compressible medium, and the other pressure chamber being connected via duct in the frame to a pressure fluid space of the percussion piston, the outer circumference of the frame being provided with a first annular recess for forming the first pressure chamber, and the sleeve being correspondingly provided with a second annular recess for forming the second pressure chamber, and the sleeve-like diaphragm being positioned between the frame and the sleeve and arranged to move in a radial direction in said first annular recess and said second annular recess proportional to pressure acting in said two separate pressure chambers.

2. An arrangement according to claim 1, wherein a gas of a predetermined pressure is to be fed into the second pressure chamber, and the first pressure chamber is connected to the pressure fluid space of the percussion piston at least by one duct.

3. An arrangement according to claim 1, wherein the contact surface between the sleeve and the frame is provided with grooves for fastening the diaphragm, and the diaphragm comprises at its edges projections that are arranged to be placed in said grooves.

4. An arrangement according to claim 1, wherein the diaphragm comprises in the middle an enlargement that is arranged to be placed at the duct arriving from the percussion piston.

* * * * *

UNITED STATES PATENT AND TRADEMARK OFFICE

CERTIFICATE OF CORRECTION

PATENT NO. : 6,105,686
DATED : August 22, 2000
INVENTOR(S) : NIEMI

It is certified that error appears in the above-identified patent and that said letters patent is hereby corrected as shown below:

On the first page of the patent, please change the following:

"[73] Assignee: Tamrock OY, Finland" should read --[73] Assignee: Sandvik Tamrock OY, Finland--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*